US010996028B2

(12) United States Patent
Jimenez

(10) Patent No.: US 10,996,028 B2
(45) Date of Patent: May 4, 2021

(54) PEPPER SPRAY BRACELET ASSEMBLY

(71) Applicant: Sandro Jimenez, Carson, CA (US)

(72) Inventor: Sandro Jimenez, Carson, CA (US)

( * ) Notice: Subject to any disclaimer, the term of this patent is extended or adjusted under 35 U.S.C. 154(b) by 54 days.

(21) Appl. No.: 16/414,941

(22) Filed: May 17, 2019

(65) Prior Publication Data

US 2020/0363164 A1 Nov. 19, 2020

(51) Int. Cl.

| | |
|---|---|
| ***F41H 9/10*** | (2006.01) |
| ***B05B 11/00*** | (2006.01) |
| ***G08B 3/10*** | (2006.01) |
| ***G08B 15/02*** | (2006.01) |

(52) U.S. Cl.

CPC ..... *F41H 9/10* (2013.01); *B05B 11/30* (2013.01); *G08B 3/10* (2013.01); *G08B 15/02* (2013.01)

(58) Field of Classification Search

CPC ..... F41H 13/0018; F41H 13/0025; F41H 13/0081; F41H 9/10; G08B 3/10; G08B 15/02; G08B 15/004; B05B 11/30

USPC ..... 222/175, 78, 192, 402.11; 361/232

See application file for complete search history.

(56) References Cited

U.S. PATENT DOCUMENTS 4,058,237 A 11/1977 Luke
4,463,879 A 8/1984 Des Voignes
5,088,624 A 2/1992 Hackett
5,289,164 A * 2/1994 Novak ..... F41H 9/10 116/DIG. 44
5,358,144 A 10/1994 Mock
5,429,301 A * 7/1995 Franks ..... B65D 83/384 222/145.1
D365,622 S 12/1995 Edwards
5,476,192 A * 12/1995 Julinot ..... B65D 83/384 116/81
5,484,085 A * 1/1996 Bennett ..... F41H 9/10 222/175
5,503,304 A * 4/1996 Keller ..... F41H 9/10 222/175
5,673,436 A * 10/1997 Piper ..... F41H 9/10 2/160
5,924,601 A * 7/1999 Chen ..... F41H 9/10 222/175
5,961,003 A 10/1999 Coryell
6,540,106 B2 4/2003 Gerstner
7,477,504 B1 * 1/2009 Delida ..... F41H 13/0018 361/230
8,154,844 B2 * 4/2012 Brown ..... F41H 5/08 361/232

(Continued)

*Primary Examiner* — Charles P. Cheyney

(57) ABSTRACT

A pepper spray bracelet assembly includes a bracelet is worn around a user's wrist. The bracelet has a dock is integrated into the bracelet and a nozzle is in fluid communication with the dock. A cartridge is positionable in the dock such that the cartridge is in fluid communication with the nozzle. The cartridge contains pepper spray and the cartridge releases the pepper spray through the nozzle when the cartridge is turned on to direct the pepper spray at an assailant. A button is movably coupled to the bracelet and the button turns the cartridge on when the button is depressed. A speaker is coupled to the bracelet to emit an audible alarm outwardly therefrom. The speaker is electrically coupled to the button and the speaker is turned on when the button is depressed to alert bystanders that the user of the bracelet is under duress.

6 Claims, 3 Drawing Sheets

(56) References Cited

U.S. PATENT DOCUMENTS

| | | | | |
|---|---|---|---|---|
| 8,517,896 | B2 * | 8/2013 | Robinette | A63B 69/0028 482/8 |
| 8,854,789 | B2 * | 10/2014 | Crandall | F41H 13/0012 361/232 |
| 9,347,749 | B2 | 5/2016 | Olah | |
| 10,175,032 | B2 * | 1/2019 | Cooper | F41H 9/10 |
| 2007/0080935 | A1 * | 4/2007 | Hanson | G06F 1/1601 345/156 |
| 2009/0143689 | A1 * | 6/2009 | Berry | A63B 24/00 600/508 |
| 2011/0056989 | A1 | 3/2011 | Ceja | |

* cited by examiner

PEPPER SPRAY BRACELET ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to bracelet devices and more particularly pertains to a new bracelet device for self defense.

BRIEF SUMMARY OF THE INVENTION

An embodiment of the disclosure meets the needs presented above by generally comprising a bracelet is worn around a user's wrist. The bracelet has a dock is integrated into the bracelet and a nozzle is in fluid communication with the dock. A cartridge is positionable in the dock such that the cartridge is in fluid communication with the nozzle. The cartridge contains pepper spray and the cartridge releases the pepper spray through the nozzle when the cartridge is turned on to direct the pepper spray at an assailant. A button is movably coupled to the bracelet and the button turns the cartridge on when the button is depressed. A speaker is coupled to the bracelet to emit an audible alarm outwardly therefrom. The speaker is electrically coupled to the button and the speaker is turned on when the button is depressed to alert bystanders that the user of the bracelet is under duress.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
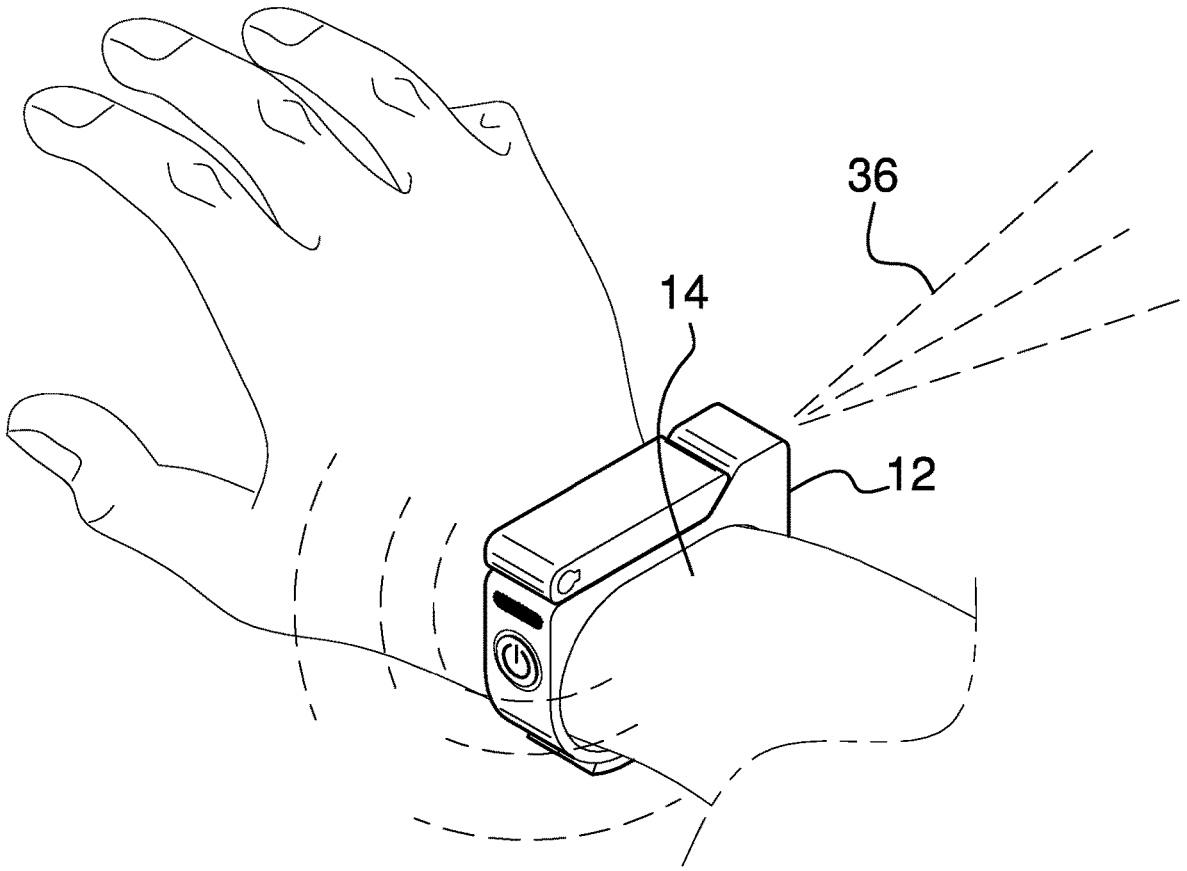
FIG. 1 is a perspective in-use view of a pepper spray bracelet assembly according to an embodiment of the disclosure.
Figure 2:
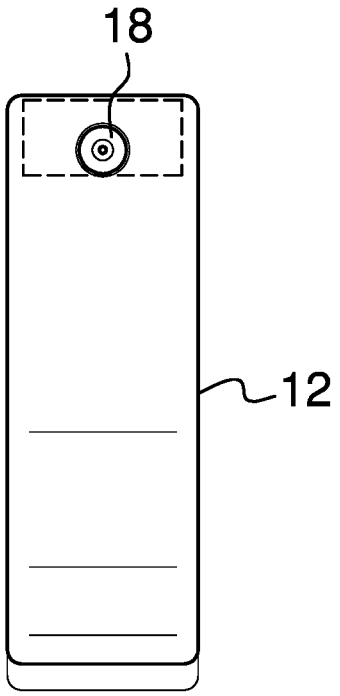
FIG. 2 is a front view of an embodiment of the disclosure.
Figure 3:
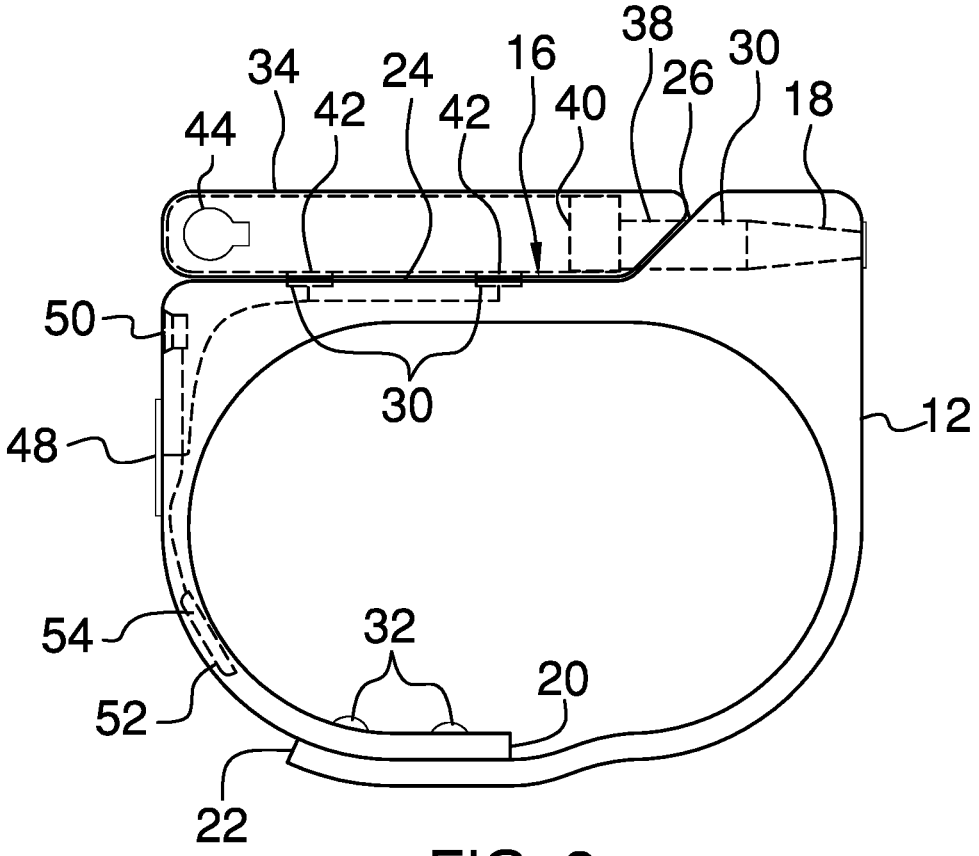
FIG. 3 is a right side phantom view of an embodiment of the disclosure.
Figure 4:
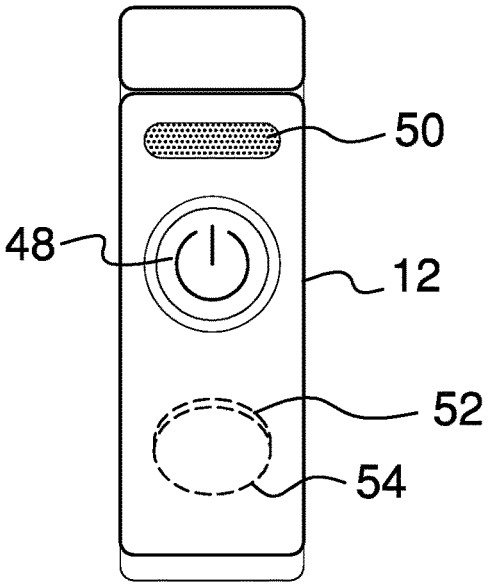
FIG. 4 is a back phantom view of an embodiment of the disclosure.
Figure 5:
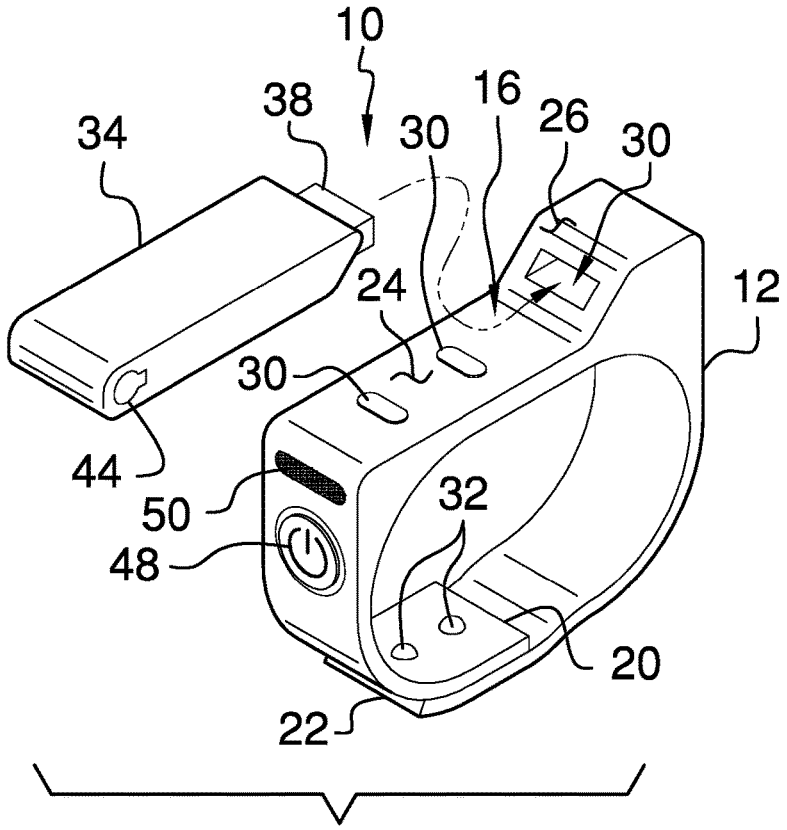
FIG. 5 is an exploded perspective view of an embodiment of the disclosure.

With reference now to the drawings, and in particular to FIGS. 1 through 5 thereof, a new bracelet device embodying the principles and concepts of an embodiment of the disclosure and generally designated by the reference numeral 10 will be described.

As best illustrated in FIGS. 1 through 5, the pepper spray bracelet assembly 10 generally comprises a bracelet 12 that is worn around a user's wrist 14. A dock 16 is integrated into the bracelet 12 and a nozzle 18 is in fluid communication with the dock 16. The dock 16 is centrally positioned between each of a first end 20 and a second end 22 of the bracelet 12. Thus, the dock 16 is positioned on top of the user's wrist 14 when the bracelet 12 is worn. The dock 16 has a lower surface 24 and a forward surface 26. The nozzle 18 includes an input 28 extending through the forward surface 26 of the dock 16. A pair of first contacts 30 is each of the first contacts 30 is coupled to the lower surface 24 of the dock 16 and each of the first contacts 30 are comprised of an electrically conductive material.

A pair of engagements 32 is each coupled to the bracelet 12. Each of the engagements 32 is positioned adjacent to the first end 20 of the bracelet 12. Additionally, each of the engagements 32 releasably engages the bracelet 12 at a point adjacent to the second end 22 of the bracelet 12 to retain the bracelet 12 in a closed loop around the user's wrist 14. Each of the engagements 32 may be raised tabs that each extends through a corresponding hole in the bracelet 12 or any other type of releasable engagement.

A cartridge 34 is positionable in the dock 16 such that the cartridge 34 is in fluid communication with the nozzle 18. The cartridge 34 contains pepper spray 36, mace or any other type of personal defense, aerosol repellant. The cartridge 34 releases the pepper spray 36 through the nozzle 18 when the cartridge 34 is turned on to direct the pepper spray 36 at an assailant. The cartridge 34 has an output 38 and the output 38 engages the input 28 of the nozzle 18 when the cartridge 34 is positioned in the dock 16.

A pump 40 is positioned within the cartridge 34 and the pump 40 is fluidly coupled to the output 38. The pump 40 urges the pepper spray 36 outwardly through the output 38 when the pump 40 is turned on. The pump 40 may be an electronic fluid pump or the like. A pair of second contacts 42 is each coupled to the cartridge 34 and each of the second contacts 42 is electrically coupled to the pump 40. Moreover, each of the second contacts 42 engages a respective one of the first contacts 30 when the cartridge 34 is positioned in the dock 16. Each of the second contacts 42 is comprised of an electrically conductive material.

A charge port 44 is recessed into the cartridge 34 and the charge port 44 can be fluidly coupled to a pepper spray source 46 for refilling the cartridge 34 with pepper spray 46. A button 48 is movably coupled to the bracelet 12 and the button 48 is in electrical communication with the cartridge 34 when the cartridge 34 is positioned in the dock 16. The button 48 turns on the cartridge 34 when the button 48 is depressed. The button 48 is electrically coupled to each of the second contacts 42 such that the button 48 is in electrical communication with the pump 40 when the cartridge 34 is positioned in the dock 16. In this way the pump 40 is turned on when the button 48 is depressed thereby facilitating the cartridge 34 to spray the pepper spray 36 outwardly through the nozzle 18.

A speaker 50 is coupled to the bracelet 12 wherein the speaker 50 is configured to emit an audible alarm outwardly therefrom. The speaker 50 is electrically coupled to the button 48 and the speaker 50 is turned on when the button 48 is depressed. In this way the speaker 50 can alert bystanders that the user of the bracelet 12 is under duress. A power supply 52 is coupled to the bracelet 12 and the power supply 52 is electrically coupled to each of the second contacts 42. The power supply 52 comprises at least one rechargeable battery 54. The power supply 52 is in electrical communication with the charge port 44 when the cartridge 34 is positioned in the dock 16 for charging the at least one rechargeable battery 54.

In use, the bracelet 12 is worn when the user is outdoors or in a public area. The user raises their wrist 14 such that the nozzle 18 is pointed at an assailant and the user depresses the button 48. Thus, the pepper spray 36 is released from the nozzle 18 and the speaker 50 emits the audible alarm. In this way, not only is the assailant deterred, but the speaker 50 alerts bystanders to the danger. In this way the user is protected from the assailant and the user calls for assistance from bystanders.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pepper spray bracelet assembly being configured to emit an audible alarm and release pepper spray when a wearer is threatened, said assembly comprising:

a bracelet being worn around a user's wrist, said bracelet having a dock being integrated into said bracelet and a nozzle being in fluid communication with said dock, said dock being centrally positioned between each of a first end and a second end of said bracelet wherein said dock is configured to be positioned on top of the user's wrist when said bracelet is worn, said dock having a lower surface and a forward surface, said nozzle including an input extending through said forward surface of said dock;

a cartridge being positionable in said dock such that said cartridge is in fluid communication with said nozzle, said cartridge containing pepper spray, said cartridge releasing said pepper spray through said nozzle when said cartridge is turned on wherein said bracelet is configured to direct said pepper spray at an assailant, said cartridge having an output, said output engaging said input of said nozzle when said cartridge is positioned in said dock;

a button being movably coupled to said bracelet, said button being in electrical communication with said cartridge when said cartridge is positioned in said dock, said button turning said cartridge on when said button is depressed;

a speaker being coupled to said bracelet wherein said speaker is configured to emit an audible alarm outwardly therefrom, said speaker being turned on when said button is depressed wherein said speaker is configured to alert bystanders that the user of said bracelet is under duress;

a pump being positioned within said cartridge, said pump being fluidly coupled to said output such that said pump urges said pepper spray outwardly through said output when said pump is turned on;

a pair of first contacts, each of said first contacts being coupled to said lower surface of said dock; and a pair of second contacts, each of said second contacts being coupled to said cartridge, each of said second contacts being electrically coupled to said pump, each of said second contacts engaging a respective one of said first contacts when said cartridge is positioned in said dock.

2. The assembly according to claim 1, further comprising a pair of engagements, each of said engagements being coupled to said bracelet, each of said engagements being positioned adjacent to said first end of said bracelet, each of said engagements releasably engaging said bracelet at a point adjacent to said second end of said bracelet to retain said bracelet in a closed loop around the user's wrist.

3. The assembly according to claim 1, further comprising a charge port being recessed into said cartridge wherein said charge port is configured to be fluidly coupled to a pepper spray source for refilling said cartridge with said pepper spray.

4. The assembly according to claim 1, wherein said speaker is electrically coupled to said button, said button being electrically coupled to each of said second contacts such that said button is in electrical communication with said pump when said cartridge is positioned in said dock.

5. The assembly according to claim 3, further comprising a power supply being coupled to said bracelet, said power supply being electrically coupled to each of said second contacts, said power supply comprising at least one rechargeable battery, said power supply being in electrical communication with said charge port when said cartridge is positioned in said dock for charging said at least one rechargeable battery.

6. A pepper spray bracelet assembly being configured to emit an audible alarm and release pepper spray when a wearer is threatened, said assembly comprising:

a bracelet being worn around a user's wrist, said bracelet having a dock being integrated into said bracelet and a nozzle being in fluid communication with said dock, said dock being centrally positioned between each of a first end and a second end of said bracelet wherein said dock is configured to be positioned on top of the user's wrist when said bracelet is worn, said dock having a lower surface and a forward surface, said nozzle including an input extending through said forward surface of said dock;

a pair of first contacts, each of said first contacts being coupled to said lower surface of said dock;

a pair of engagements, each of said engagements being coupled to said bracelet, each of said engagements being positioned adjacent to said first end of said bracelet, each of said engagements releasably engaging said bracelet at a point adjacent to said second end of said bracelet to retain said bracelet in a closed loop around the user's wrist;

a cartridge being positionable in said dock such that said cartridge is in fluid communication with said nozzle, said cartridge containing pepper spray, said cartridge releasing said pepper spray through said nozzle when said cartridge is turned on wherein said bracelet is configured to direct said pepper spray at an assailant, said cartridge having an output, said output engaging said input of said nozzle when said cartridge is positioned in said dock;

a pump being positioned within said cartridge, said pump being fluidly coupled to said output such that said pump urges said pepper spray outwardly through said output when said pump is turned on;

a pair of second contacts, each of said second contacts being coupled to said cartridge, each of said second contacts being electrically coupled to said pump, each of said second contacts engaging a respective one of said first contacts when said cartridge is positioned in said dock;

a charge port being recessed into said cartridge wherein said charge port is configured to be fluidly coupled to a pepper spray source for refilling said cartridge with said pepper spray;

a button being movably coupled to said bracelet, said button being in electrical communication with said cartridge when said cartridge is positioned in said dock, said button turning said cartridge on when said button is depressed, said button being electrically coupled to each of said second contacts such that said button is in electrical communication with said pump when said cartridge is positioned in said dock;

a speaker being coupled to said bracelet wherein said speaker is configured to emit an audible alarm outwardly therefrom, said speaker being electrically coupled to said button, said speaker being turned on when said button is depressed wherein said speaker is configured to alert bystanders that the user of said bracelet is under duress; and a power supply being coupled to said bracelet, said power supply being electrically coupled to each of said second contacts, said power supply comprising at least one rechargeable battery, said power supply being in electrical communication with said charge port when said cartridge is positioned in said dock for charging said at least one rechargeable battery.

* * * * *